US012421807B2

(12) United States Patent
Johnson et al.

(10) Patent No.: US 12,421,807 B2
(45) Date of Patent: Sep. 23, 2025

(54) CONNECTION ASSEMBLY AND METHOD TO ASSEMBLE SUCKER ROD

(71) Applicant: TRC Services, Inc., The Woodlands, TX (US)

(72) Inventors: Donald Mike Johnson, The Woodlands, TX (US); Michael Eric Johnson, The Woodlands, TX (US); Rodrigo Ariel Ruiz, The Woodlands, TX (US)

(73) Assignee: TRC Services, Inc., The Woodlands, TX (US)

( * ) Notice: Subject to any disclaimer, the term of this patent is extended or adjusted under 35 U.S.C. 154(b) by 0 days.

(21) Appl. No.: 18/617,572

(22) Filed: Mar. 26, 2024

(65) Prior Publication Data

US 2024/0328263 A1 Oct. 3, 2024

Related U.S. Application Data

(60) Provisional application No. 63/454,849, filed on Mar. 27, 2023.

(51) Int. Cl.
*E21B 17/04* (2006.01)
*F04B 47/02* (2006.01)

(52) U.S. Cl.
CPC ..... *E21B 17/04* (2013.01); *F04B 47/026* (2013.01)

(58) Field of Classification Search
CPC ..... E21B 17/03–0465
See application file for complete search history.

(56) References Cited

U.S. PATENT DOCUMENTS

| | | | | |
|---|---|---|---|---|
| 2,251,031 A | | 7/1941 | Bozeman, Jr. | |
| 2,438,313 A | * | 3/1948 | Burton | E21B 17/043 403/300 |
| 2,874,937 A | | 2/1959 | Higgins | |
| 2,874,938 A | | 2/1959 | Higgins | |
| 2,876,993 A | * | 3/1959 | Hooks | E21B 31/107 175/301 |
| 3,489,445 A | | 1/1970 | Kammerer, Jr. | |
| 3,534,989 A | | 10/1970 | Yonkers | |
| 4,064,953 A | | 12/1977 | Collins | |
| 4,297,787 A | | 11/1981 | Fischer | |
| 4,360,288 A | | 11/1982 | Rutledge, Jr. et al. | |

(Continued)

FOREIGN PATENT DOCUMENTS

| | | |
|---|---|---|
| CA | 2824658 A1 | 2/2014 |
| WO | 2016057976 A1 | 4/2016 |

OTHER PUBLICATIONS

Int'l Search Report and Written Opinion in PCT-US2024/021547 dated Jun. 13, 2024, 10-pgs.

*Primary Examiner* — David Carroll
(74) *Attorney, Agent, or Firm* — Cabello Hall Zinda PLLC

(57) ABSTRACT

An assembled sucker rod includes a rod body with a rod end and an endpiece containing a receptacle at the rod end. An adhesive is set between the receptacle and rod end, and an insert is positioned through the endpiece's side, contacting the rod end, and resisting compressive loads. The endpiece has apertures for the insert, which has ends and an intermediate portion; the latter contacts the rod end compressively, while the ends contact the endpiece oppositely. The rod end may feature a hole or slot for the insert, or its distal portion may directly abut the insert.

21 Claims, 10 Drawing Sheets

(56) References Cited

U.S. PATENT DOCUMENTS 4,401,396 A * 8/1983 McKay ..... F16B 11/008 403/268
4,422,508 A * 12/1983 Rutledge, Jr. ..... E21B 43/127 166/376
4,430,018 A 2/1984 Fischer
4,435,615 A 3/1984 Kaczerginski et al.
4,475,839 A 10/1984 Strandberg
4,484,833 A 11/1984 Gallagher, Jr.
4,585,368 A * 4/1986 Pagan ..... E21B 17/00 403/268
4,597,688 A * 7/1986 Pagan ..... F16B 7/02 156/289
4,653,953 A 3/1987 Anderson et al.
4,787,771 A 11/1988 Allen
4,796,799 A 1/1989 Rasi-Zade et al.
5,253,946 A 10/1993 Watkins
6,193,431 B1 2/2001 Rutledge
6,193,461 B1 2/2001 Hablanian
6,472,604 B2 10/2002 Nakamura et al.
8,113,277 B2 2/2012 Rutledge, Sr. et al.
10,195,699 B2 2/2019 Johnson et al.
10,280,683 B1 * 5/2019 Smid ..... F04C 15/0076
10,288,065 B1 * 5/2019 Smid ..... F16D 3/205
10,378,209 B2 8/2019 Martin et al.
11,168,549 B2 11/2021 Ewing et al.
11,199,053 B2 12/2021 Johnson et al.
2008/0217914 A1 9/2008 Rutledge et al.
2013/0336711 A1 12/2013 Hale et al.
2015/0300148 A1 10/2015 Johnson
2015/0368989 A1 * 12/2015 Lauder ..... E21B 17/0465
2016/0060968 A1 3/2016 Xie
2016/0060969 A1 * 3/2016 Rutledge ..... E21B 17/1071 403/361
2016/0102504 A1 4/2016 Gernentz et al.
2016/0102694 A1 4/2016 Gernentz et al.
2017/0211365 A1 7/2017 Johnson et al.
2020/0232285 A1 * 7/2020 Johnson ..... E21B 19/00
2021/0363834 A1 * 11/2021 Ficken ..... E21B 17/03
2022/0098934 A1 * 3/2022 Löher ..... E21B 7/26

* cited by examiner

CONNECTION ASSEMBLY AND METHOD TO ASSEMBLE SUCKER ROD

CROSS-REFERENCE TO RELATED APPLICATIONS

This application claims the benefit of U.S. Provisional Appl. No. 63/454,849 filed Mar. 27, 2023, which is incorporated herein by reference in its entirety.

BACKGROUND

A sucker rod is a rigid rod used in the oil industry to connect surface equipment to a reciprocating piston pump installed in an oil well. These rods are typically between 25 and 40 feet (7 to 12 meters) in length and are threaded at both ends.

For example, FIG. 1 shows a reciprocating pump system 10 used to produce fluid from a wellbore. A downhole pump 14 has a pump barrel 16 with a standing valve 24 located at the bottom. The standing valve 24 allows fluid to enter from the wellbore, but the valve 24 does not allow the fluid to leave. Inside the pump barrel 16, a plunger 20 has a traveling valve 22, which allows fluid to move from below the plunger 20 to the production tubing 18 above, but the valve 22 does not allow fluid to return from the tubing 18 to the pump barrel 16 below the plunger 20. A driving source (e.g., a pump jack or pumping unit 26) at the surface connects by a rod string 12 to the plunger 20 and moves the plunger 20 up and down cyclically in upstrokes and downstrokes to lift fluid to the surface.

As shown in FIG. 1, the rod string 12 is comprised of multiple sucker rods 30 connected end-to-end by couplings 38. The sucker rods 30 and the couplings 38 have standards for their design, manufacture, and assembly from the American Petroleum Institute (API).

A steel sucker rod 30 as shown in FIG. 2 typically includes a length of a rod body, such as a steel bar or rod, 32 having ends 34 that are upset and forged onto the rod 30. After forging, the rod 30 is heat treated, and thread rollers are utilized to thread pins 36 on the ends 34 of the rod 30. A coupling 38 threaded to the pins 36 is used to connect the rods 30 end-to-end.

This manufacturing process of forging and heat treating, however, is susceptible to forging errors and the introduction of defects, such as micro-fractures, in the ends 34, particularly where the ends 34 join to the steel rod body 32. Furthermore, after the forging process, the steel rod 30 must be heat treated in an effort to reduce residual stresses and other potential defects and/or stress concentrators that can be introduced into the steel rod body 32 and/or the end 34 during the forging process. Heat treating adds both time and expense to the manufacture of sucker rods. Therefore, one technique for forming a sucker rod that does not require heat treatment of forged ends uses separate an assembled joint, end fitting, or endpiece connected to the end of the rod body.

For example, FIG. 3A illustrates an elevational view of an assembled sucker rod 30 according to the prior art, and FIG. 3B shows one end of the assembled sucker rod 30 in cross-section. The sucker rod 30 includes a rod body 32 having ends 33. The sucker rod 30 includes assembled joints, end fittings, or endpieces 40 each having a recess 42 configured to receive one of the ends 33 of the rod body 32.

The endpiece 40 includes a threaded pin connection 48, such as an API standard connection. The endpiece 40 also includes wrench flats 46 configured to receive a wrench or other similar tool to tighten the connection between the sucker rod 30 and an adjacent sucker rod using a coupling, as noted previously.

To affix the endpiece 40 to the rod body 32, an adhesive 50 is configured to secure the endpiece 40 to the end 33 of the rod body 32. The recess 42 includes wedged features 44 so the adhesive 50, once cured, adheres to the sucker rod body 32 and forms an internal wedge system with the wedged features 44 of the recess 42.

This wedge system locks the endpiece 40 under a tension (positive) load on the rod body 32, but the wedge system does not successfully lock the endpiece 40 under a compression (negative) load on the rod body 32. During use, the assembled sucker rod 30 can be exposed to compression loads at times.

For example, the plunger 20 on the pump 14 of FIG. 1 may contact the pump barrel 16 in what is known as tagging in the industry. This tagging can cause the rod body 32 and endpieces 40 to undergo compression, which can separate the wedge system and cause a catastrophic failure of the assembly.

The subject matter of the present disclosure is directed to overcoming, or at least reducing the effects of, one or more of the problems set forth above.

SUMMARY OF THE DISCLOSURE

A method disclosed herein is directed to manufacturing an assembled sucker rod. The method starts with obtaining a rod body that has a rod end, and an endpiece which defines a receptacle designed to receive this rod end. The method involves affixing the rod end within the receptacle by applying an adhesive to either the rod end or the receptacle. This adhesive could be either a two-part or a one-part epoxy resin. The next steps involve installing the rod end into the receptacle, allowing the adhesive to set, which may involve applying a curing agent, leaving it to set for a period, applying heat, or applying pressure, and then applying a tensile load between the rod end and the endpiece up to a certain threshold.

Further steps in the method include installing an insert through at least one side of the endpiece. This insert, which is positioned to contact a portion of the rod end, is designed to resist compressive loads between the endpiece and the rod end. The method of affixing the rod end in the receptacle can include wedging the adhesive in annular ramped profiles defined between them.

To install the insert, a hole can be drilled through one side of the endpiece, through the receptacle, and into at least a portion of the opposing side of the endpiece. Then, the insert can be installed in this hole. In other options, this hole can be drilled through the rod end, adjacent to a distal portion of the rod end, or at least partially into the distal portion of the rod end. The process can also comprise pre-drilling an aperture through the endpiece's side before affixing the rod end inside the receptacle.

A connection assembly disclosed here is used for an assembled sucker rod having a rod end. The connection assembly comprises an endpiece, an adhesive, and an insert. The endpiece defines a receptacle configured to receive the rod end. The adhesive is set in an annular area between rod end and the endpiece. The insert, which is resistant to compressive load between the endpiece and the rod end, is insertable through at least one side of the endpiece and is configured to position in contact with a portion of the rod end at least in a compressive direction toward the rod body. The adhesive can be set using a curing agent, time setting, application of heat, or pressure application. Additionally, the receptacle of the endpiece can include an engagement feature which may use threads, teeth, ridges, grooves, wedges, or ramps. The endpiece has first and second apertures for inserting the insert, which can be inserted in a hole or slot in the rod end or abut against its distal portion.

An assembled sucker rod comprises a rod body with a rod end, an endpiece with a receptacle on the rod end, adhesive in a set condition between them, and an insert installed through the endpiece side. The insert contacts the rod end in a compressive direction and resists compressive load between the endpiece and the rod end. The endpiece can include apertures on both sides for the insert, which has opposing ends and an intermediate portion that contacts the rod end. The materials used can include several types of metals and composites for different parts such as the rod body, endpiece, and insert.

The foregoing summary is not intended to summarize each potential configuration or every aspect of the present disclosure.

DETAILED DESCRIPTION

Figure 4A:
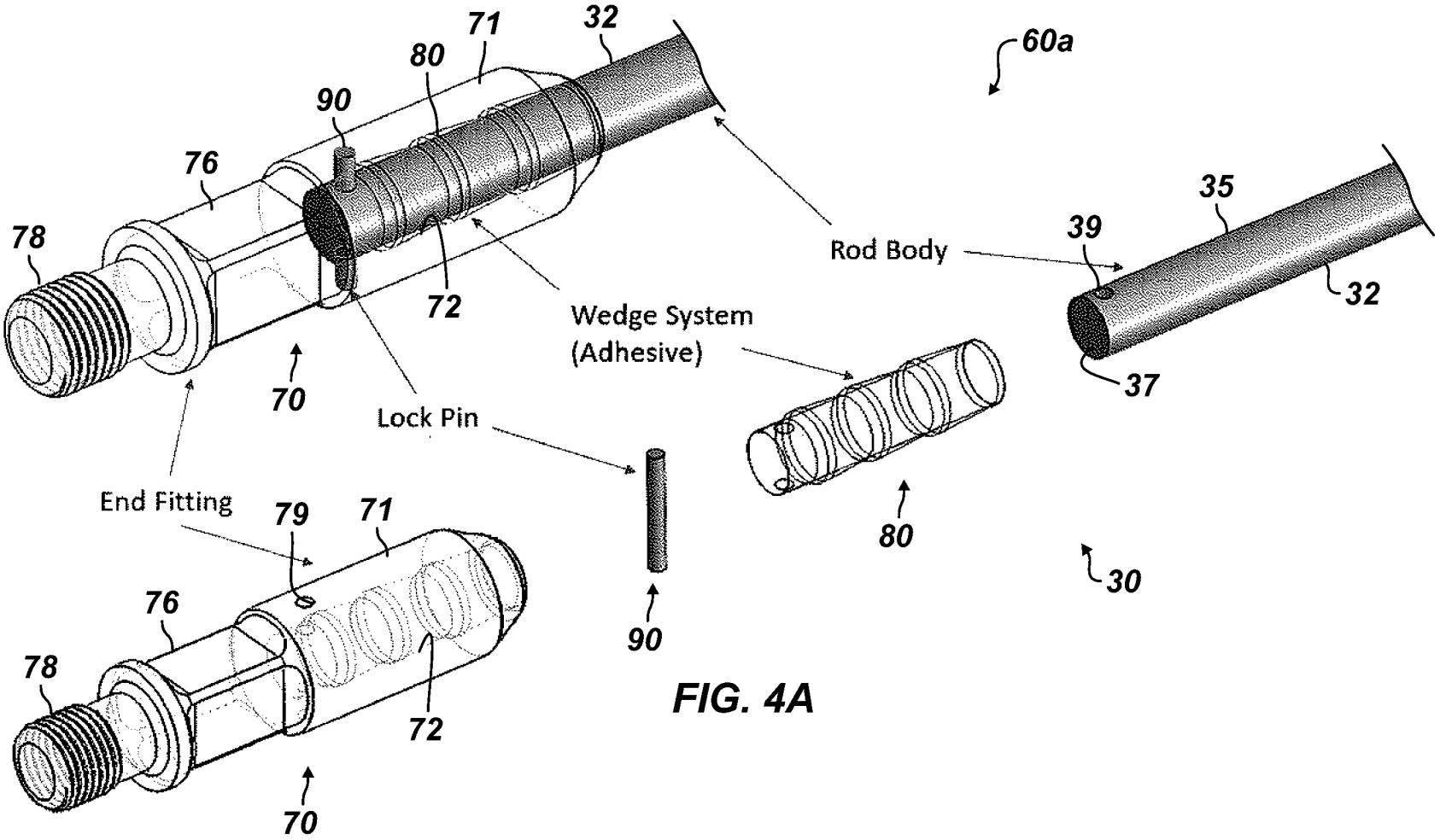
FIG. 4A illustrates a first connection assembly of the present disclosure in disassembled and assembled states for use on an assembled sucker rod.
Figure 4B:
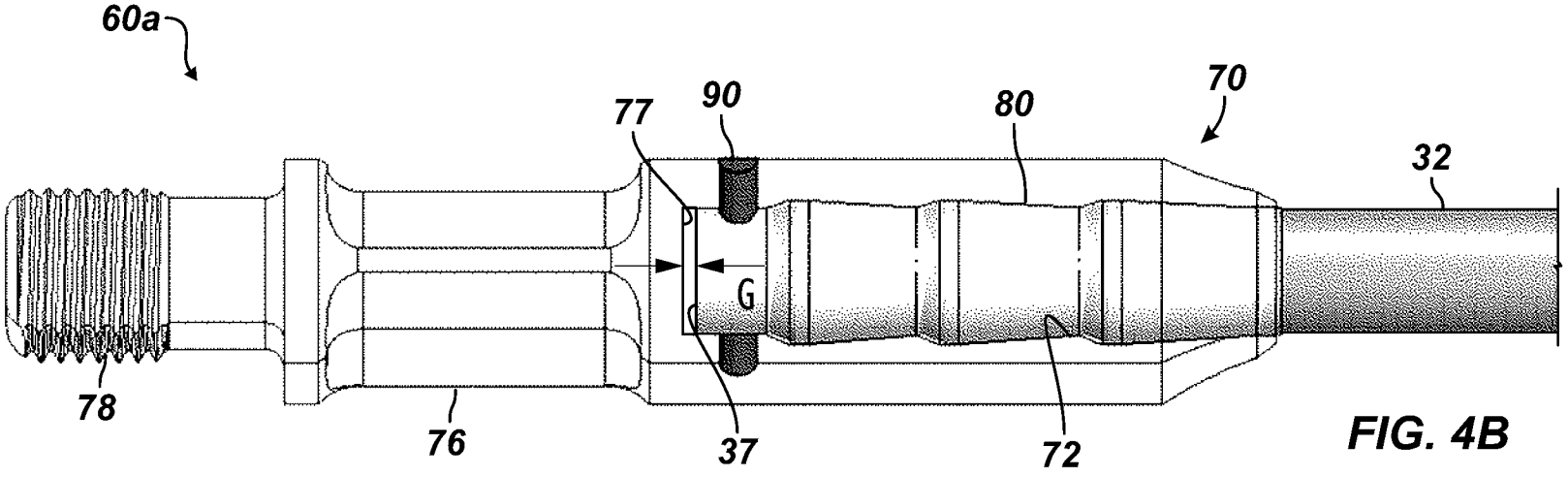
FIG. 4B illustrates schematic view of the first connection assembly in the assembled state.

FIG. 4A illustrates a first connection assembly 60*a* of the present disclosure for use on an assembled sucker rod 30. In FIG. 4A, the components are shown in disassembled and assembled states. FIG. 4B illustrates a schematic view of the first connection assembly 60*a* in the assembled state.

The assembled sucker rod 30 includes a rod body 32 having opposing ends 35 (only one of which is shown). As is typical, the rod's ends 35 can be cylindrical, but other shapes are possible. In general, the rod body 32 can be a solid rod, and the rod body 32 can be composed of metal, fiberglass, or other appropriate material used for downhole sucker rod systems. The metal for the sucker rod 30 can be any type of metal, such as aluminum, steel, and any composition of those metals. Aluminum and steel, as used herein, encompasses any composition that includes those base metals of aluminum and iron with any selected additional elements as desired.

The first connection assembly 60*a* for the sucker rod 30 includes an endpiece 70, an adhesive 80, and an insert 90. The endpiece 70, which can be an assembled joint or end fitting, includes a body 71, which is composed of a suitable metal material, such as steel, and can be formed by forging and machining. The body 71 defines a receptacle 72 therein at one end and has a threaded pin end 78 extending from an opposite end. The endpiece 70 may also optionally include wrench flats 76 configured to receive a wrench or other similar tool to tighten the connection between the sucker rod 30 and an adjacent sucker rod. For example, the threaded pin end 78 can connect with a coupling (38) to a complementary pin on an adjoining sucker rod. The wrench flat 76 can be engaged by a tong to make up the coupling connection between the adjoining sucker rods. Alternatively, the threaded pin end 78 can connect to a box end of an endpiece on an adjoining sucker rod.

The receptacle 72 is configured to receive the rod end 35 of the rod body 32. The other end (not shown) of the rod body 32 can also include an endpiece. To affix the endpiece 70 to the rod end 35, the adhesive 80 is applied to at least one of a) the rod end 35 of the rod body 32, and b) the receptacle 72 of the endpiece 70. The adhesive 80 fills the annular area between the sucker rod surface and the receptacle 72 and secures the endpiece 70 to the rod end 35 of the rod body 32.

In general, the adhesive 80 is configured to be set by at least one of a) a curing agent appropriate for the specific adhesive 80, b) setting, e.g., leaving the adhesive 80 undisturbed, for a period of time, c) applying heat to the adhesive 80 through the use of a heat soak, heat lamps, heat guns, and other sources of heat, and d) applying pressure to the adhesive 80, whether circumferentially, or through a force that applies compression or tension.

In general, the adhesive 80 can include any type of adhesive suitable for affixing metal-to-metal or affixing metal-to-fiberglass. In some embodiments, the adhesive 80 comprises one of a) a two-part epoxy resin and b) a one-part epoxy resin. The various epoxy resins can be of any type suitable, particularly those suitable for use in a wellbore, combining metal-to-metal or metal-to-fiberglass, exposure to hydrocarbons and/or water, exposure to temperatures up to 500° F. (260° C.), and pressures up to 20,000 pounds per square inch (138 MPa).

In addition to the use of the adhesive 80 to affix the rod end 35, the receptacle 72 includes an engagement feature 74 configured to couple or lock the endpiece 70 on the rod end 35 of the rod 30. As shown here, the engagement features 74 includes a plurality of ramped or wedged profiles configured to engage the rod end 35 of the rod body 32 to the receptacle 72 with the adhesive 80 disposed therebetween. In general, the engagement features 74 can use thread, teeth, ridges, grooves, wedges, ramps, or other three-dimensional shapes.

Figure 5A:
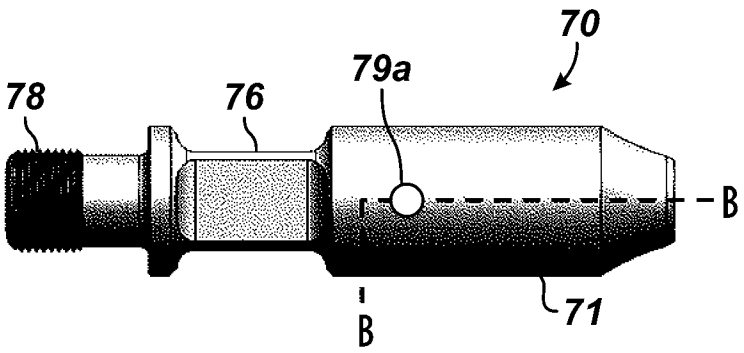
FIG. 5A illustrates a side view of the endpiece for the first connection assembly.
Figure 5B:
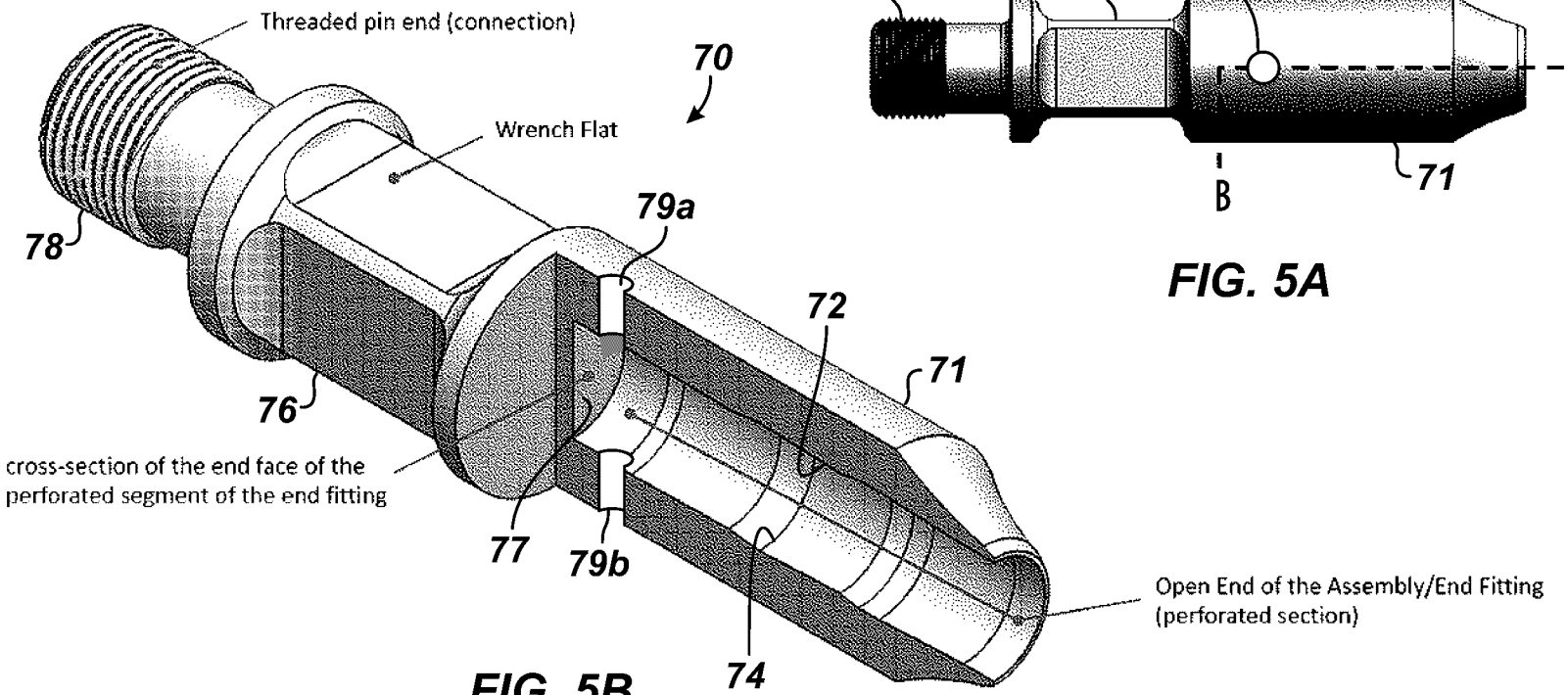
FIG. 5B illustrates a partial cross-sectional view of the endpiece for the first connection assembly.

FIG. 5A illustrates a side view of the endpiece 70, and FIG. 5B illustrates a partial cross-sectional view of the endpiece 70 for the first connection assembly 60*a*. The receptacle 72 defines a plurality of ramped profiles 74 defined circumferentially thereabout. An aperture or hole 79*a* is defined in one side of the endpiece 70 and communicates with the receptacle 72. This aperture 79*a* is formed near an inside surface or face 77 of the receptacle 72. An opposing aperture or hole 79*b* can be defined at least partially in the opposite side of the endpiece 70 and can communicate with the receptacle 72. In this example, the aperture 79*b* passes through the side, but only a partial aperture 79*b* may be used. These apertures 79*a-b* permit the insertion of the insert (90) as discussed below. The apertures 79*a-b* can be formed (i.e., drilled) into the endpiece 70 after assembly to the rod end 35 as discussed below, although they could be formed before assembly.

Figure 6:
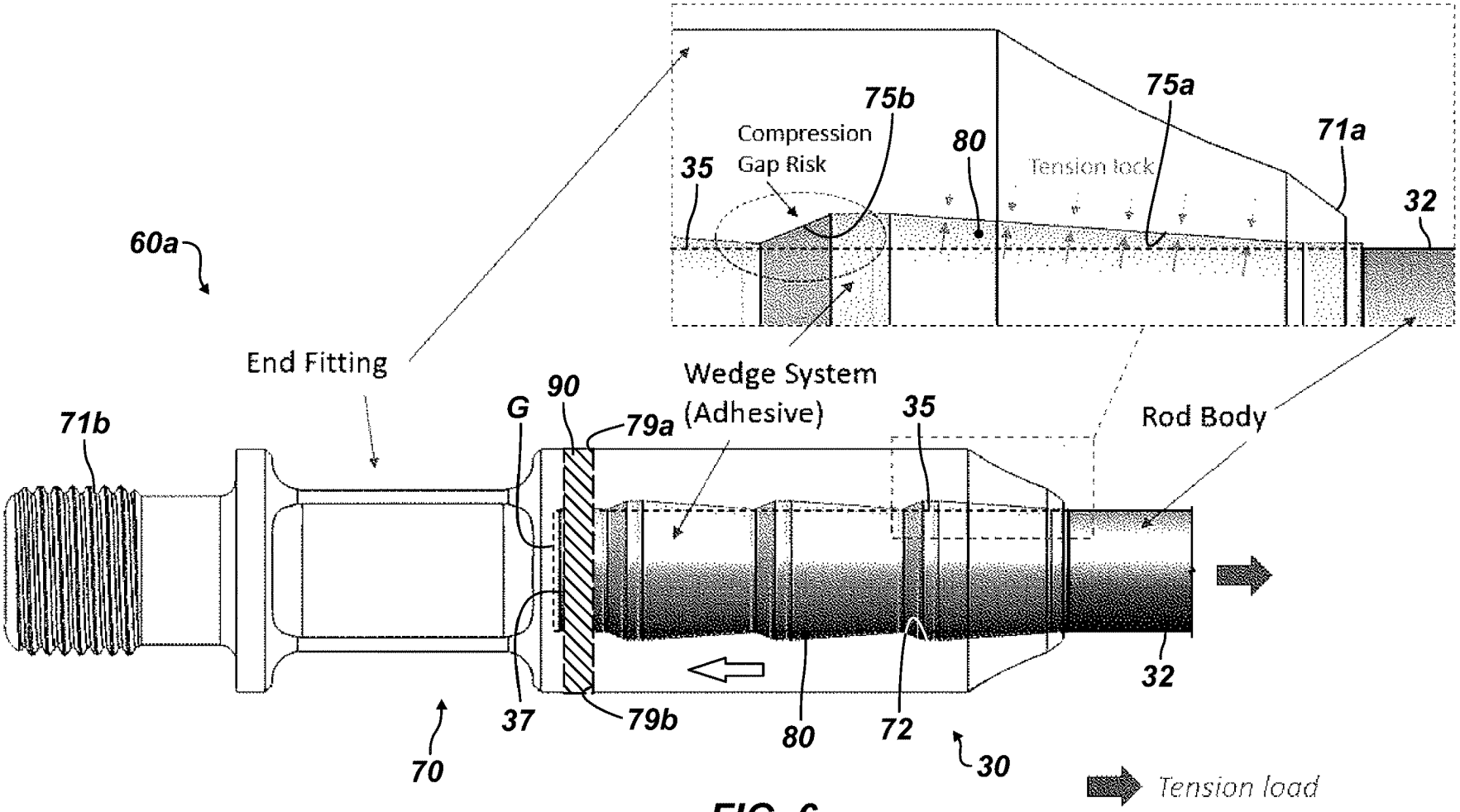
FIG. 6 diagrams the first connection assembly of the present disclosure.

FIG. 6 diagrams the first connection assembly 60*a* of the present disclosure in more detail. The rod end 35 of the rod body 32 is affixed with a wedge system of the adhesive 80 disposed in the annular area between the sucker rod surface and the ramped profiles 74 of the receptacle 72. Each of the ramped profiles 74 has a first inclined surface 75*a* and a second inclined surface 75*b*.

The first inclined surface 75*a* is defined at a first (shallow) angle diverting outward from longitudinal axis and extending a first (long) extent. The first inclined surface 75*a* diverges in a direction from the receptacle end 71*a* toward the threaded pin end 71*b* of the endpiece 70.

The second inclined surface 75*b* is defined at a second (sharp) angle converging inward from first inclined surface 75*a* toward the threaded pin end 71*b* of the endpiece 70. The second inclined surface 75*b* has a shorter extent compared to the first extent, and the second angle of the second inclined surface 75*b* is a much greater angle of convergence than the divergent angle of the first inclined surface 75*a*.

Thus, the ramped profiles 74 form a wedge system of the adhesive 80 set in the annulus between the receptacle 72 and the rod end 35 of the rod body 32. As already noted, the adhesive 80 can be set by at least one of a) applying a curing agent to the adhesive 80, b) allowing the adhesive 80 to set for a period of time, c) applying heat to the adhesive 80, and d) applying pressure to the adhesive 80. The adhesive 80 can be a two-part epoxy resin or a one-part epoxy resin. For example, the adhesive 80 is cured while the rod body 32 and the endpiece 70 are held together. The curing process depends on the adhesive 80 used. For example, the endpiece 70 and rod body 32 can be heated to a predetermined temperature for a defined time period to cure the adhesive 80.

The sucker rod 30 is preferably held in tension during operation. Accordingly, this wedge system locks the endpiece 70 under a tension (positive) load on the rod end 35 of the rod body 32. For example, the wedge adhesive 80 and the first inclined surface 75*a* produce a tension lock of the endpiece 70 on the sucker rod 30, and the tension lock resists the removal of the endpiece 70 from the rod end 35 of the sucker rod 30.

At times, however, the rod body 32 and the endpiece 70 can be subject to compression, such as when the downhole pump bottoms out or when tagging occurs. The wedge adhesive 80 and the second inclined surface 75*b* may have gaps therebetween. As best shown in FIG. 4B, for example, a gap G may particularly be present between a distal face 37 of the rod body 32 and an inside face 77 of the receptacle 72. The compressive and tensile loads acting on the connection assembly 60*a* loosen the wedge assembly because the gap G allows for movement or play between the rod end 35 and the endpiece 70.

This is the case for the rod body 32 composed of steel and fiberglass. In fact, the rod body 32 composed of fiberglass would tend to stretch significantly more than a steel sucker rod body, and the amount of stretch in the fiberglass rod body 32 would tend to constantly change with the fluid level in the well. Accordingly, mitigating compressive loads is useful for sucker rods 30 having a rod body 32 composed of fiberglass and metal, such as steel.

To mitigate these effects and to handle compressive loading, the connection assembly 60*a* of the present disclosure includes the insert 90 disposed through the endpiece 70, the wedge adhesive 80, and the sucker rod end 35. The insert 90 is positioned in contact at least in a compressive direction with a portion of the rod end 35. (The compressive direction is the direction in which a compressive load attempts to push the endpiece 70 and rod end 35 together, as opposed to a tensile direction in which tensile load attempts to pull them apart.) As shown in FIGS. 4A-4B and 6, the insert 90 can be a cylindrical pin installed through the connection assembly 60*a*. Besides a cylindrical pin, the insert 90 can have other shapes, such as being flat and elongated, a bar, a plate, etc. As noted below, the insert 90 is installed after the wedge system of the adhesive 80 is set in a tension loaded state.

The insert 90 can be composed of a high strength material, such as a metal material of steel, titanium, or the like. Alternatively, the insert 90 can be composed of a high strength composite material, such as a polymer, a thermoplastic, or the like. As noted, the insert 90 is disposed in the apertures 79*a-b*, which are defined in the sides of the endpiece 70 and communicate with the receptacle 72. In the example here of FIGS. 4A-4B, 5A-5B, and 6, both apertures 79*a-b* are defined entirely through the sides. One aperture 79*a* is at least defined from outside the body 71 to inside the receptacle 72 so the insert 90 can be inserted. The other aperture 79*b* may not be present or may only need to be partially defined into the inner side exposed to the receptacle 72. Primarily, the insert 90 is positioned to resist compressive loading in any gap present or produced in the wedge system between the rod end 35 and the endpiece 70.

The insert 90 can be positioned at various positions within the receptacle 72 of the assembly 90*a*. In the present configuration, the insert 90 passes transverse to the rod end 35, namely the insert 90 goes through the rod end 35 in all its circumference, such as shown here. Thus, the insert 90 passes through a hole (39; FIG. 4A) defined through the rod end 35 of the rod body 32 near the distal face 37. Drilling and machining can be used to form the apertures 79*a-b* through the endpiece 70, the hole (39) through the rod end 35, and any adhesive 80 on the connection assembly 60*a* in the assembled state.

Figure 7B:
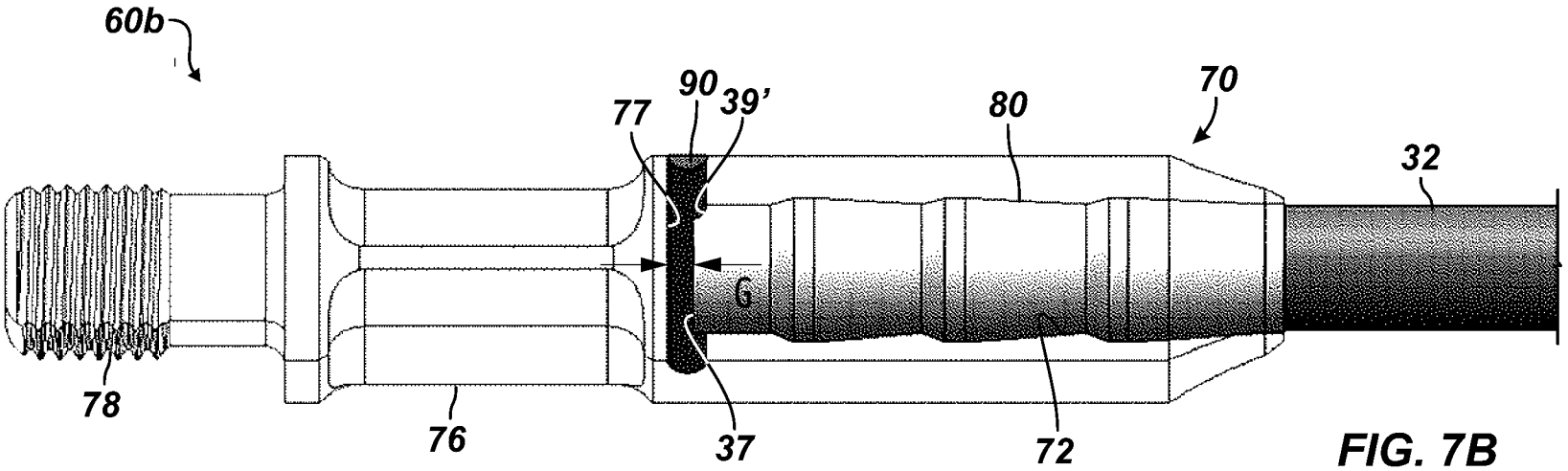
FIG. 7B illustrates schematic view of the second connection assembly in the assembled state.
Figure 7A:
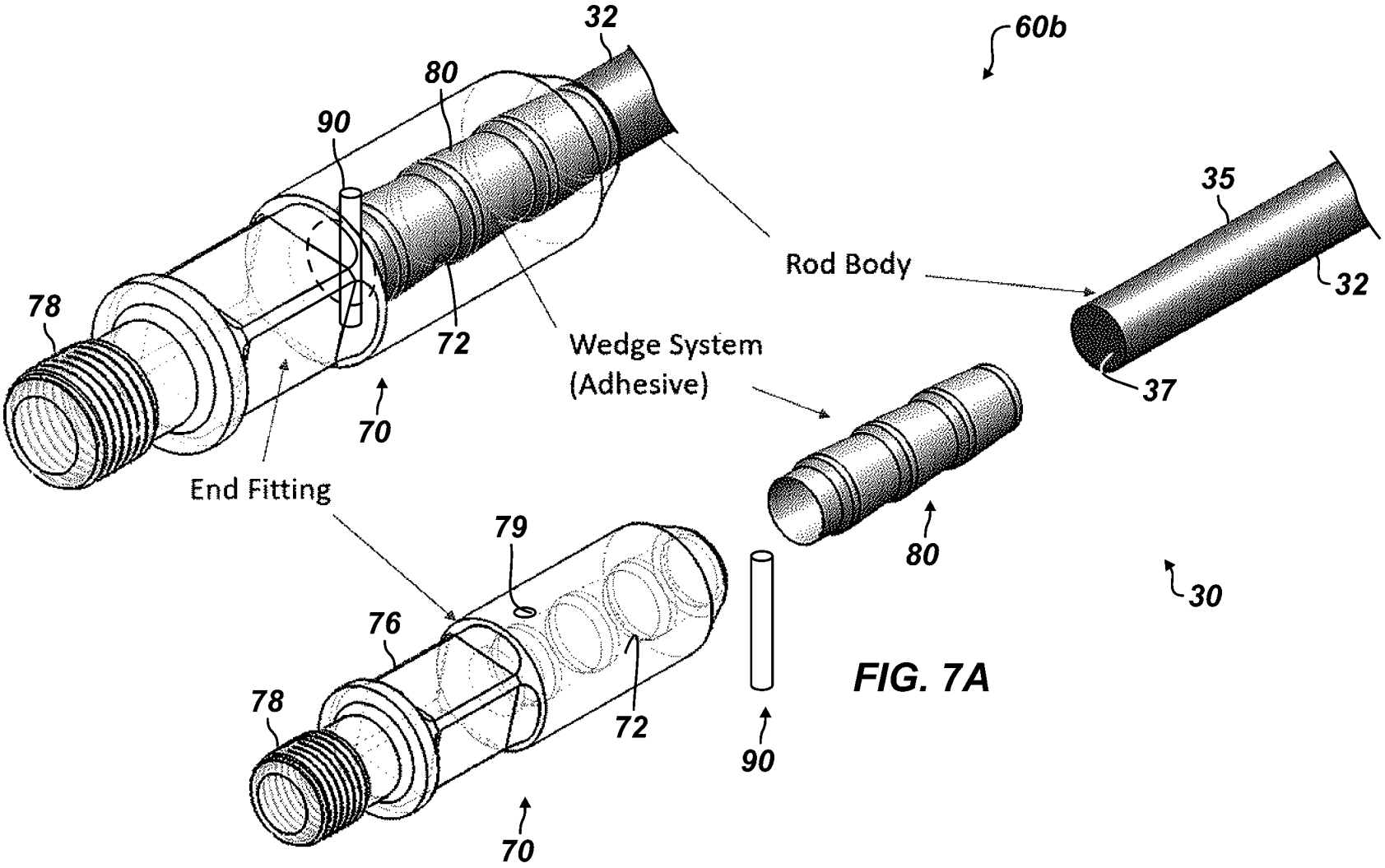
FIG. 7A illustrates a second connection assembly of the present disclosure in disassembled and assembled states for use on an assembled sucker rod.

FIG. 7A illustrates a second connection assembly 60*b* of the present disclosure for use on an assembled sucker rod 30. In FIG. 7A, the components are shown in disassembled and assembled states on the rod end 35 of the rod body 32. FIG. 7B illustrates schematic view of the second connection assembly 60*b* in the assembled state on the rod end 35 of the rod body 32.

This second connection assembly 60*b* is similar to that disclosed above so that the same reference numerals are used for similar components. As noted, the insert 90 can be positioned at different positions within the receptacle 72 of the connection assembly 60*b*. In this configuration, the insert 90 is located adjacent to the rod end's distal face 37, having one side of the insert 90 in contact with the rod body 32 and having the other side of the insert 90 in direct contact with the inside face 77 of the receptacle 72 or in direct contact with edges of the apertures 79*a-b*. One aperture 79*a* is defined through the endpiece 70 to permit insertion of the insert 90. An opposing aperture 79*b* may not be necessary or may only be partially defined in the opposing side of the endpiece 70. A portion of the inside face 77 and/or the distal face 37 can have a slot defined therein for engaging with the insert 90. As shown in FIG. 7B, for example, the distal face 37 of the rod end 35 defines a slot 396' in which the insert 90 fits.

As already noted, the sucker rod 30 is preferably held in tension during operation. Accordingly, the wedge system of the adhesive 80 locks the endpiece 70 under a tension (positive) load on the rod body 32. For example, the wedge adhesive 80 and the first inclined surface (75*a*) produce a tension lock of the endpiece 70 on the sucker rod 30, and the tension lock resists the removal of the endpiece 70 from the rod end 35 of the sucker rod 30.

At times, however, the rod body 32 and the endpiece 70 can be subject to compression, such as when the downhole pump bottoms out or when tagging occurs. The wedge adhesive 80 and the second inclined surface (75*b*) may tend to form a gap therebetween when the connection assembly 60*a* is subject to compression. This gap can increase over-time if subjected to repeated compressive loads. This gap G may particularly be present between the distal face 37 of the rod body 32 and the inside face 77 of the receptacle 72 as shown in FIG. 7B. Accordingly, the insert 90 is used to handle compressive loading. As before, the insert 90 is positioned in contact at least in a compressive direction with a portion of the rod end 35.

Figure 8A:
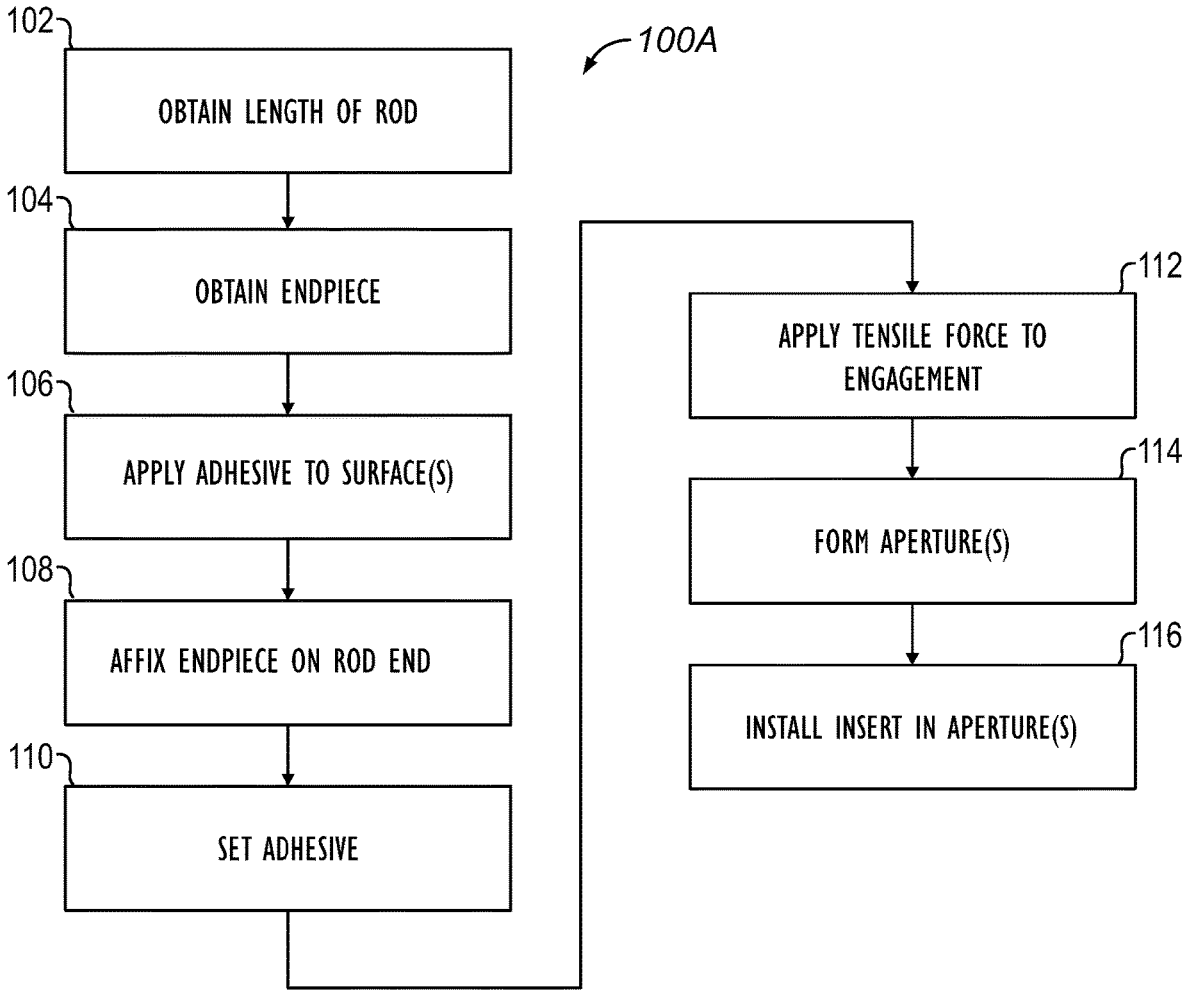
FIG. 8A shows a method of manufacturing an assembled sucker rod according to the present disclosure.

FIG. 8A illustrates a method 100A of manufacturing an assembled sucker rod 30 with endpieces 70 according to the present disclosure disposed on a rod body 32. The method 100A includes obtaining a rod body 32 having a desired length between rod ends 35 (Block 102). This rod body 32 can be formed from newly manufactured rod stock or can be from a remanufactured rod. In remanufacture, for example, rod ends on a used sucker rod may be cleaned, cut, or otherwise prepared to receive endpieces.

The method 100A also includes obtaining at least one endpiece 70 configured to receive one of the rod ends 35 of the rod body 32 (Block 104). As noted above, the endpiece 70 is a separately formed component from the rod body 32 and can be forged and machined from stock material. In general, the material used for the endpiece 70 can be the same or different from the material used for the rod body 32. The endpiece 70 is manufactured with the receptacle 72 (and any internal engagement features 74) and with the pin end 78, wrench flats 76, etc.

The rod end 35 is affixed inside the receptacle 72 by applying an adhesive 80 to at least one of the rod end 35 and the receptacle 72 and by installing the rod end 35 into the receptacle 72. The adhesive 80 can be applied to surface(s), including those of at least one of a) the rod end 35 of the rod body 32 and b) in the receptacle 72 of the at least one endpiece 70 (Block 106).

After applying the adhesive 80, the rod end 35 is inserted into the receptacle 72 of the endpiece 70, and the adhesive 80 is set (Block 108). With the rod end 35 made up to the receptacle 72, the adhesive 80 fills the annular area of the ramped profiles 74, and the adhesive 80 is then set (Block 110). Setting the adhesive 80 can include at least one of a) applying a curing agent, b) allowing the adhesive to set for a period of time, c) applying heat, and d) applying pressure.

When affixing and setting the endpiece 70 on the rod end 35, the method may further include applying a tensile force to at least one of the endpiece 70 and the rod body 32 (Block 112). Applying the tensile force may aid in setting or locking the engagement feature 74 in the receptacle 72 of the endpiece 70. To apply the tensile force, the rod body 32 can be held at one end, while the pin end 78, wrench flats 76, or another surface of the endpiece 70 can be held at the other. Displacement between the two can put the connection therebetween, namely the engagement features 74 of the rod end 35 in tension, while the adhesive 80 sets.

For example, after setting, the connection 60*a-b* is subject to a tensile load in which the endpiece 70 and rod end 35 of the rod body 32 are pulled in opposite directions up to a tensile threshold, such as 48,000 lbs. The pulling prepares the connection 60*a-b* for use so the adhesive 80 in the annular ramped profiles 74 is wedged between the receptacle 72 and the rod end 35.

The application of the tensile force may produce a gap G, and/or the gap G can be preconfigured in the machining of the endpiece 70 and the rod end 35 of the rod body 32. In many instances, for example, this pulling can produce the gap G in the receptacle 72 between the distal face 37 of the rod's end 35 and the inside shoulder 77 of the receptacle 72. The gap G can be about 1/16th to 1/8th of an inch. As expected, the use of the assembled sucker rod 30 under tension during operation can add to this gap G. When exposed to compressive loads, the gap G allows for movement or play, which can lead unsetting the wedge assembly and can leave the connection assembly 60 completely loosened.

At this point in the manufacturing process, for example, a hole or a passage can be drilled through the connection assembly 60*a-b* (Block 114). A drilled aperture 79*a* can extend through at least one side of the endpiece 70 and can reach through to the receptacle 72. An aperture 79*b* can be formed into at least a portion on the other side of the endpiece 70. In one arrangement, the hole or apertures 79*a-b* can be drilled through the endpiece 70 from side to side, and the hole can pass through a distal portion of the rod's end 35 so that the rod end 35 has a hole 39 or slot 39'.

The method 100A now includes placing an insert 90 configured to resist compression at least partially within the gap G (Block 116). As noted, this insert 90 can include a pin that fits through the endpiece 70, any adhesive, and a part of the rod end 35.

Figure 8B:
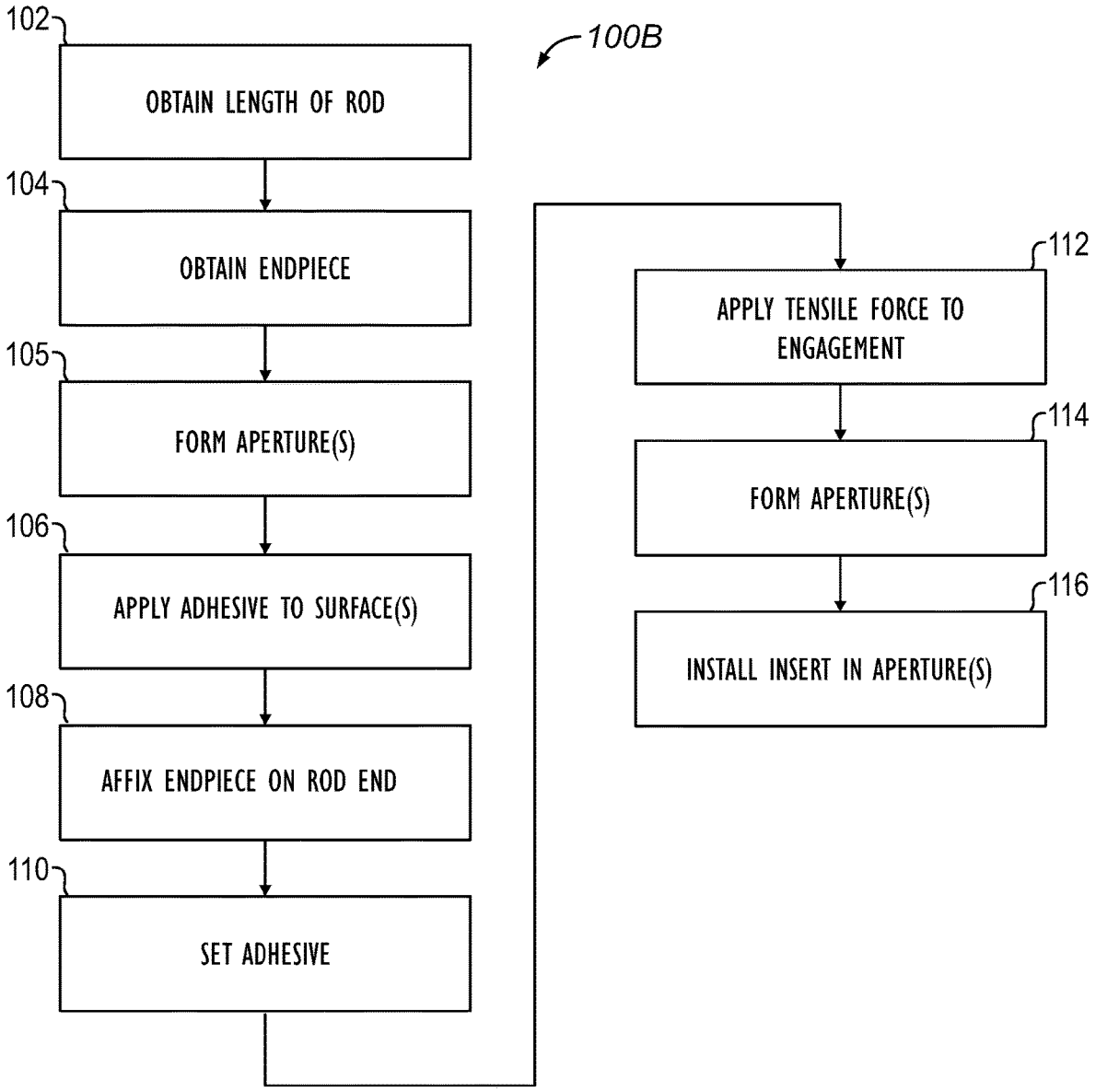
FIG. 8B shows another method of manufacturing an assembled sucker rod according to the present disclosure.

In another arrangement, the endpiece 70 may already have pre-drilled aperture(s) 79*a-b*. For example, FIG. 8B illustrates another method 100B of manufacturing an assembled sucker rod 30 with endpieces 70 according to the present disclosure disposed on a rod body 32. The method 100B includes many of the same steps as outlined previously so they are not repeated here. In this method 1001B, aperture(s) are formed in the endpiece 70 before assembly (Block 105). For example, the endpiece 70 can be forged and machined to have pre-drilled aperture(s) 79*a-b*, or the aperture(s) 79*a-b* can be formed once assembly is performed. As expected, the presence of the pre-drilled aperture(s) 79*a-b* may necessitate specific handling when the adhesive 80 is being applied and cured in Blocks 106, 108, and 110. Temporary plugs can be placed in the pre-drilled aperture(s) 79*a-b* during these steps. After applying and curing the adhesive 80, a hole 39, slot 39', or other suitable aperture can then be drilled through the rod end 35 and any adhesive 80 exposed at the endpiece's apertures 79*a-b* (Block 114) so the insert 90 can be installed (Block 116).

Figure 8C:
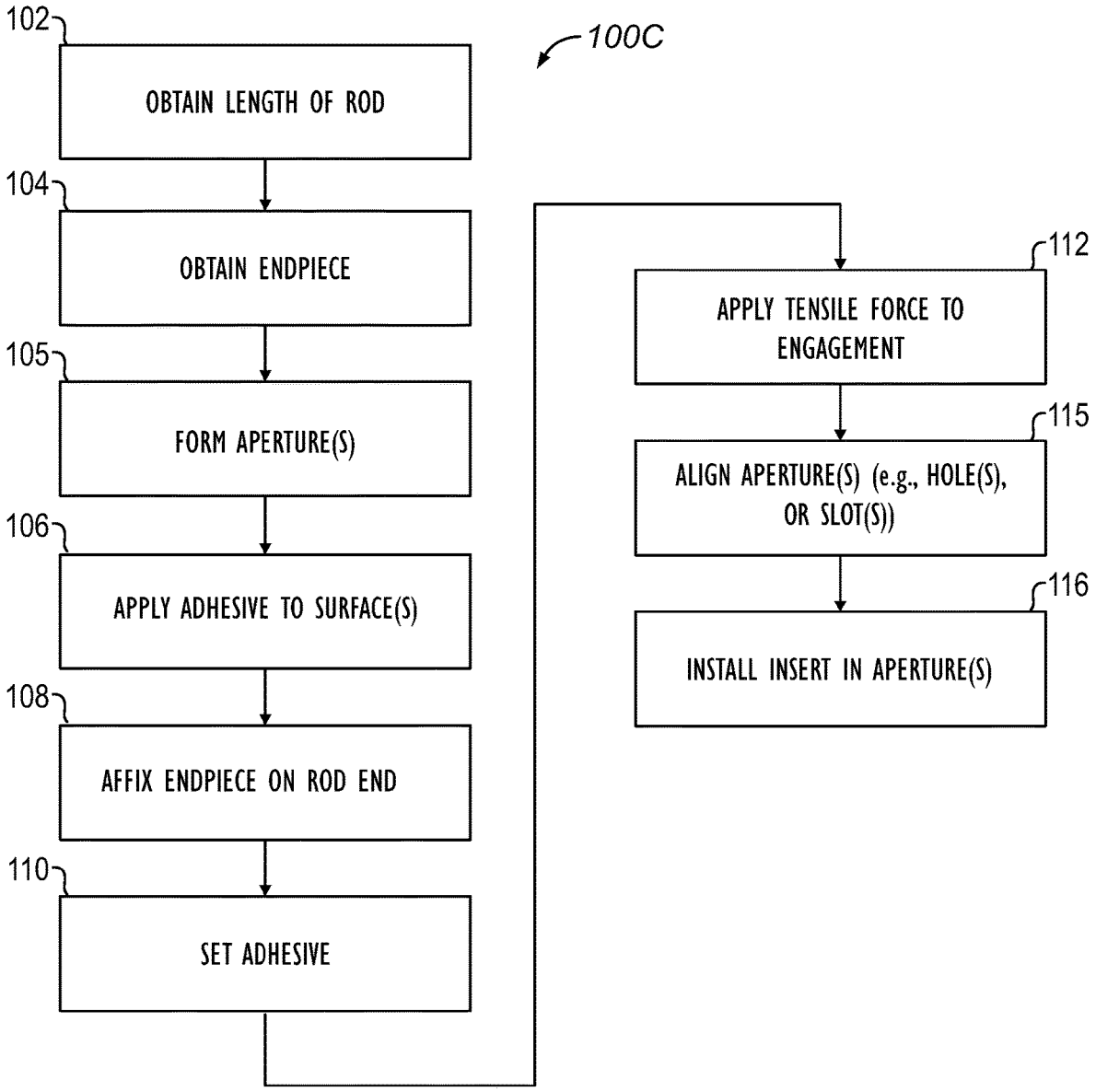
FIG. 8C shows yet another method of manufacturing an assembled sucker rod according to the present disclosure.

In yet another arrangement, both the endpiece 70 and the rod end 35 may already have pre-drilled holes. For example, FIG. 8C illustrates another method 1000 of manufacturing an assembled sucker rod 30 with endpieces 70 according to the present disclosure disposed on a rod body 32. The method 1000 includes many of the same steps as outlined previously so they are not repeated here. In this method 1000, aperture(s) are formed in the endpiece 70 and in the rod end 35 of the rod body 32 before assembly (Block 105). For example, the endpiece 70 can be forged and machined to have pre-drilled aperture(s) 79*a-b* or the aperture(s) 79*a-b* can be formed once assembly is performed. Likewise, the rod end 35 of the rod body 32 can be machined to have an appropriate hole 39 or slot 39' as noted herein (Block 105).

As expected, the presence of the aperture(s) (e.g., holes or slots) in the endpiece 70 and rod end 35 may necessitate specific handling when the adhesive 80 is being applied and cured (Blocks 106, 108, 110) and may also necessitate alignment to be present after pulling (Blocks 112 and 115). Therefore, it may be preferred to drill the hole through the connection assembly 60*a-b* after the curing and pulling steps, as done in the method 100A of FIG. 8A.

According to the present disclosure and as noted above, the compression insert 90 is installed in the aperture(s), hole(s), or slot(s) of the connection assembly 60*a-b*. As previously shown, the insert 90 can be a cylindrical pin, and the aperture(s), hole(s), or slot(s) can have a cylindrical shape. Of course, other shapes can be used. The insert 90 can be inserted and held in the aperture(s), hole(s), or slot(s) with an interference fit. Additionally or alternatively, additional adhesive (not shown) can be used between the insert 90 and aperture(s), hole(s), or slot(s) for retention. In yet another alternative, a sleeve (not shown) can be shrunk fit or compression fit about the outside surface of the endpiece 70 and can cover the aperture(s) 79*a-b* with the insert 90 installed to retain the insert 90 in place. These and other techniques can be used.

As noted by the arrangement of the second connection assembly 60*b* of FIGS. 7A-7B, the compression insert 90 installed in a hole or a passage does not pass through the rod's end 35. In this arrangement, the hole can be drilled through the connection assembly 60*b* extending through an aperture 79*a* in at least one side of the endpiece 70, reaching through the receptacle 72, and into an aperture 79*b* in at least a portion on the other side of the endpiece 70. In one arrangement, a hole can be drilled through the endpiece 70 from side to side, and the hole can pass adjacent to or at least partially into the distal face 37 of the rod's end 35 and/or into the inside face 77 of the receptacle 72. Again, other arrangements may already have a pre-drilled hole, which may necessitate specific handling during the curing step.

In this arrangement of FIGS. 7A-7B, the compression insert 90 is installed in the hole 79 and adjacent to the distal face 37 of the rod end 35. As before, the insert 90 can be held with an interference fit, adhesive, a sleeve, a combination thereof, and other techniques.

The connection assemblies 60*a-b* disclosed herein can be used on assembled sucker rods 30, such as those composed of fiberglass or steel. The assemblies 60*a-b* can provide a superior level of reliability never seen on assembled sucker rods because the connection assemblies 60*a-b* disclosed herein can help prevent premature failures due to negative load (compressive loads) on the sucker rod's endpieces 70.

Figure 1:
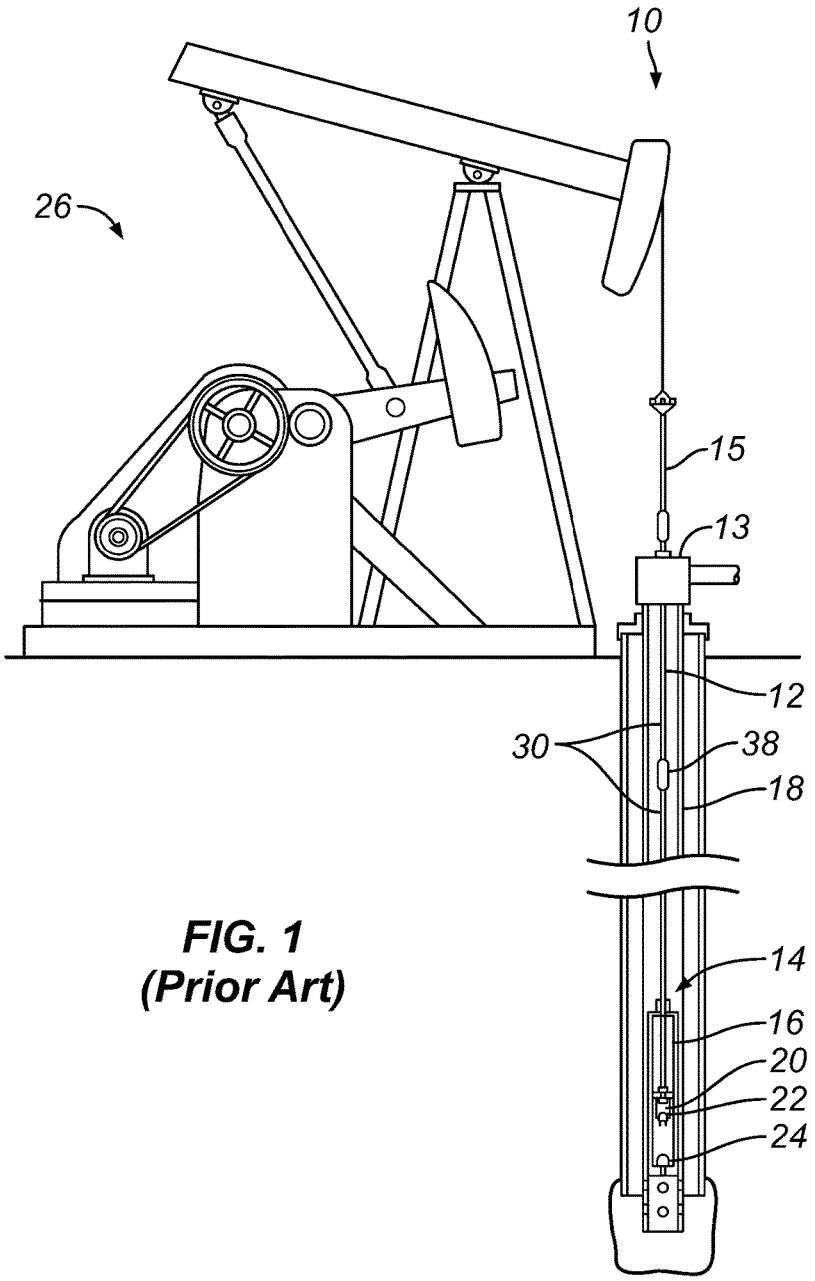
FIG. 1 (Prior Art)
FIG. 1 illustrates a reciprocating rod pump system according to the prior art.
Figure 2:
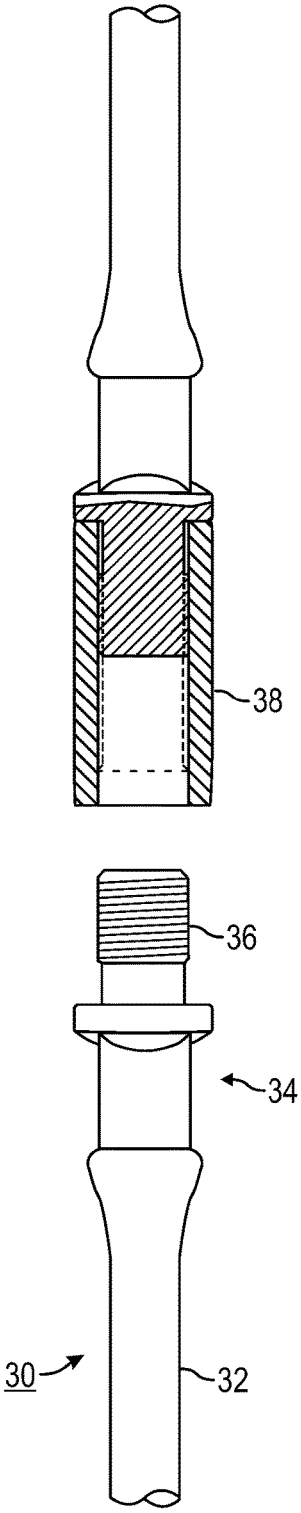
FIG. 2 (Prior Art)
FIG. 2 is an elevational view of forged sucker rod ends for coupling together with a connector.
Figure 3A:
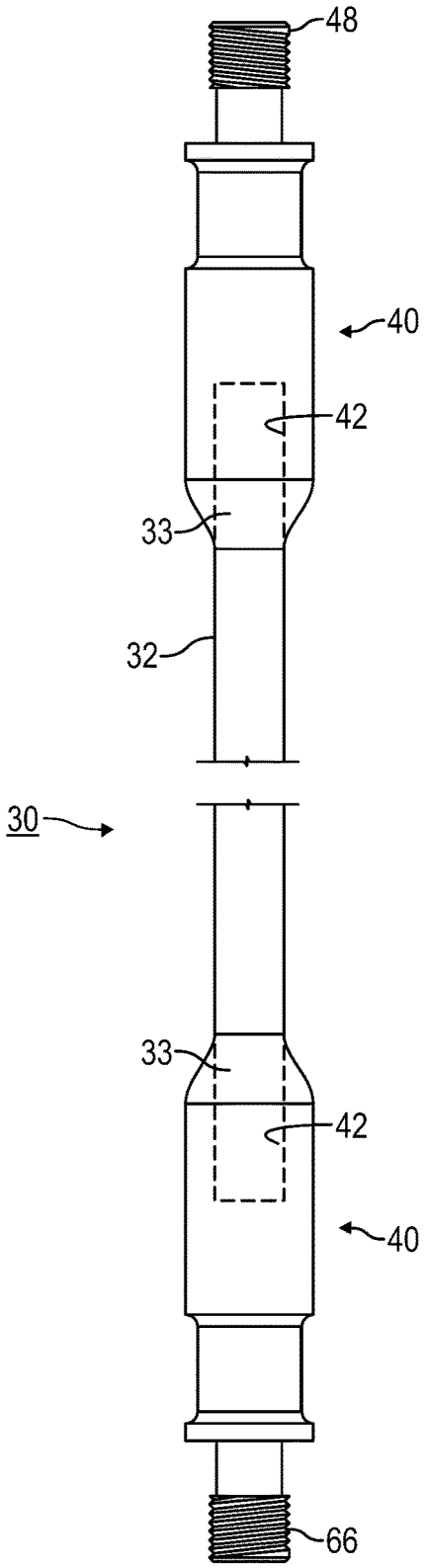
FIG. 3A (Prior Art)
FIG. 3A is an elevational view of an assembled sucker rod with adhesive-attached endpieces according to the prior art.
Figure 3B:
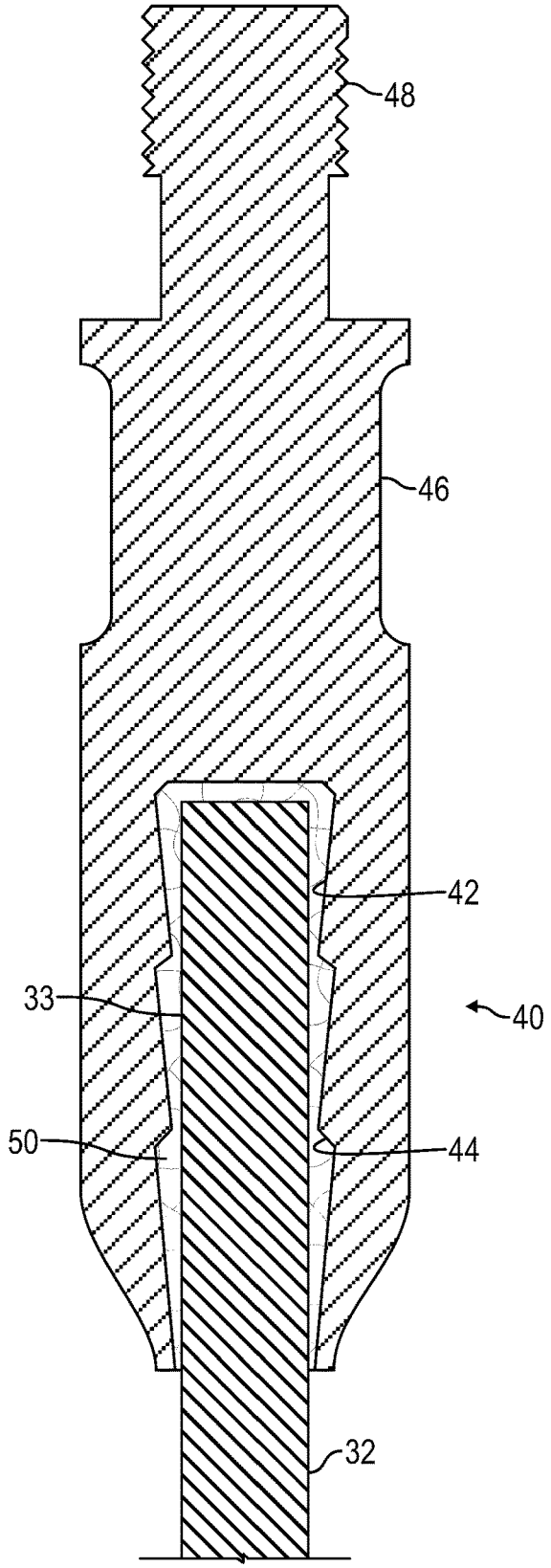
FIG. 3B (Prior Art)
FIG. 3B is cross-sectional view of a portion of the assembled sucker rod and the adhesive-attached endpiece of FIG. 3A.

Finally, an assembled sucker rod in the prior art having an endpiece affixed on the sucker rod body as shown in FIGS. 3A-3B cannot support significant rotation. In particular, an assembled sucker rod shown in FIGS. 3A-3B cannot be used with a progressive cavity pump. Given that an assembled sucker rod 30 having a connection assembly 60*a-b* according to the present disclosure "locks" the endpiece 70 to the rod body 32 and can prevent their rotation relative to one another, the assembled sucker rod 30 can be used in implementations in which the rod 30 is rotated. For instance, an assembled sucker rod 30 having a connection assembly 60*a-b* according to the present disclosure can be used with a progressive cavity pump.

The foregoing description of preferred and other embodiments is not intended to limit or restrict the scope or applicability of the inventive concepts conceived of by the Applicants. It will be appreciated with the benefit of the present disclosure that features described above in accordance with any configuration or aspect of the disclosed subject matter can be utilized, either alone or in combination, with any other described feature, in any other configuration or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of manufacturing an assembled sucker rod, the method comprising:

obtaining a rod body having a rod end;

obtaining an endpiece defining a receptacle configured to receive the rod end;

affixing the rod end inside the receptacle by applying an adhesive to at least one of the rod end and the receptacle, installing the rod end into the receptacle, setting the adhesive therebetween, and applying a tensile load between the rod end and the endpiece up to a tensile threshold; and installing an insert through at least one side of the endpiece, into the receptacle in which the rod end is affixed, and positioned in contact with a portion of the rod end at least in a compressive direction toward the rod body, the insert being resistive to compressive load between the endpiece and the rod end.

2. The method of claim 1, wherein setting the adhesive comprises at least one of a) applying a curing agent to the adhesive, b) allowing the adhesive to set for a period of time, c) applying heat to the adhesive, and d) applying pressure to the adhesive.

3. The method of claim 1, wherein the adhesive comprises one of a) a two-part epoxy resin and b) a one-part epoxy resin.

4. The method of claim 1, wherein affixing the rod end in the receptacle comprises wedging the adhesive in annular ramped profiles defined between the receptacle and the rod end.

5. The method of claim 1, wherein installing the insert through the at least one side of the endpiece, into the receptacle in which the rod end is affixed, and positioned in contact with the portion of the rod end comprises:

drilling a hole through the at least one side of the endpiece, through the receptacle, and into at least a portion of an opposing side of the endpiece; and installing the insert in the hole.

6. The method of claim 5, further comprising at least one of: drilling the hole through the rod end, drilling the hole adjacent to a distal portion of the rod end, and drilling the hole at least partially into the distal portion of the rod end.

7. The method of claim 1, wherein installing the insert comprises pre-drilling an aperture through the at least one side of the endpiece before affixing the rod end inside the receptacle.

8. A connection assembly for an assembled sucker rod having a rod body with a rod end, the connection assembly comprising:

an endpiece defining a receptacle, the receptacle being configured to receive the rod end, the endpiece defining a first aperture in one side of the endpiece and exposed to the receptacle, the endpiece defining a second aperture in at least a portion of an opposing side of the endpiece and exposed to the receptacle;

an adhesive being configured to affix in a set condition in an annular area between the receptacle and the rod end; and an insert being resistive to compressive load between the endpiece and the rod end, the insert being insertable through the first aperture in the one side of the endpiece and being insertable in the second aperture in at least the portion of the opposing side of the endpiece, the insert being configured to position in contact with a portion of the rod end at least in a compressive direction toward the rod body.

9. The connection assembly of claim 8, wherein the adhesive is configured to affix in the set condition by at least one of a) a curing agent, b) setting for a period of time, c) application of heat, and d) application of pressure.

10. The connection assembly of claim 8, further comprises an engagement feature defined in the receptacle of the endpiece.

11. The connection assembly of claim 10, wherein the engagement feature comprises at least one of thread, teeth, ridges, grooves, wedges, and ramps.

12. The connection assembly of claim 8, wherein the insert is configured to at least one of:

insert in a hole defined through the rod end;

insert in a slot defined in a distal portion of the rod end; and abut against the distal portion of the rod end.

13. An assembled sucker rod, comprising:

a rod body having a rod end;

an endpiece defining a receptacle disposed on the rod end;

an adhesive affixed in a set condition in an annular area between the receptacle and the rod end; and an insert being installed through at least one side of the endpiece and into the receptacle in which the rod end is affixed, the insert being positioned in contact with a portion of the rod end at least in a compressive direction toward the rod body, the insert being resistive to compressive load between the endpiece and the rod end.

14. The assembled sucker rod of claim 13, wherein the endpiece comprises:

a first aperture defined in the at least one side of the endpiece and exposed to the receptacle, the insert being installed in the first aperture; and a second aperture defined in at least a portion of an opposing side of the endpiece and exposed to the receptacle, the insert being installed in the second aperture.

15. The assembled sucker rod of claim 13, wherein the insert comprises opposing insert ends and an intermediate portion between the opposing insert ends; wherein the intermediate portion is positioned in contact at least in the compressive direction with the portion of the rod end; and wherein the opposing insert ends are positioned in contact with the endpiece at least in a direction opposite the compressive direction.

16. The assembled sucker rod of claim 13, wherein the adhesive comprises at least one of a two-part epoxy resin and a one-part epoxy resin; wherein the rod body comprises at least one of a metal material, an aluminum, a steel, and a fiberglass; and wherein the endpiece comprises at least one of a metal material, a steel, and a forged and machined material; and wherein the insert comprises at least one of a metal material, a steel, a titanium, a composite material, a polymer, and a thermoplastic.

17. The assembled sucker rod of claim 13, wherein the rod end defines a hole therethrough; and wherein the insert is installed in the hole.

18. The assembled sucker rod of claim 13, wherein a distal portion of the rod end defines a slot, and wherein the insert is installed in the slot.

19. The assembled sucker rod of claim 13, wherein a distal portion of the rod end abuts the insert.

20. A method of manufacturing an assembled sucker rod, the method comprising:

obtaining a rod body having a rod end;

obtaining an endpiece defining a receptacle configured to receive the rod end;

affixing the rod end inside the receptacle by applying an adhesive to at least one of the rod end and the receptacle, installing the rod end into the receptacle, setting the adhesive therebetween, and applying a tensile load between the rod end and the endpiece up to a tensile threshold;

drilling a hole through a side of the endpiece, through the receptacle, and into at least a portion of an opposing side of the endpiece; and installing an insert in the hole and positioned in contact with a portion of the rod end at least in a compressive direction toward the rod body, the insert being resistive to compressive load between the endpiece and the rod end.

21. An assembled sucker rod, comprising:

a rod body having a rod end, wherein a distal portion of the rod end defines a slot;

an endpiece defining a receptacle disposed on the rod end;

an adhesive affixed in a set condition in an annular area between the receptacle and the rod end; and an insert being installed through at least one side of the endpiece, wherein the insert is installed in the slot and is positioned in contact with a portion of the rod end at least in a compressive direction toward the rod body, the insert being resistive to compressive load between the endpiece and the rod end.

* * * * *